US007717393B2

(12) United States Patent
Edgmon et al.

(10) Patent No.: US 7,717,393 B2
(45) Date of Patent: May 18, 2010

(54) FIELD EASEL WITH INTEGRATED PAINT/SKETCH BOX

(76) Inventors: Susan Anette Edgmon, 16724 Stage Coach Rd., Gravette, AR (US) 72736; Billy Joe Edgmon, 16724 Stage Coach Rd., Gravette, AR (US) 72736

( * ) Notice: Subject to any disclaimer, the term of this patent is extended or adjusted under 35 U.S.C. 154(b) by 0 days.

(21) Appl. No.: 12/552,263

(22) Filed: Sep. 1, 2009

(65) Prior Publication Data

US 2009/0314917 A1 Dec. 24, 2009

Related U.S. Application Data

(63) Continuation of application No. 11/704,395, filed on Feb. 9, 2007, now abandoned.

(51) Int. Cl.
*A47B 97/04* (2006.01)

(52) U.S. Cl. ..... 248/460; 248/447; 248/451; 206/1.7; 312/231

(58) Field of Classification Search ..... 248/441.1, 248/447, 448, 449, 451, 452, 462, 165, 460; 206/1.7, 575; 312/231
See application file for complete search history.

(56) References Cited

U.S. PATENT DOCUMENTS

| | | | | |
|---|---|---|---|---|
| 2,751,271 | A * | 6/1956 | Dessertenne et al. | 312/231 |
| 3,514,173 | A * | 5/1970 | Ford | 312/231 |
| 3,540,787 | A * | 11/1970 | Ford | 312/231 |
| 4,093,326 | A * | 6/1978 | Ford | 312/231 |
| 4,165,856 | A * | 8/1979 | Wiseheart | 248/449 |
| 6,206,183 | B1 * | 3/2001 | Helsel | 206/1.7 |
| 7,118,084 | B2 * | 10/2006 | Park | 248/460 |
| 7,455,275 | B1 * | 11/2008 | Astadan et al. | 248/441.1 |
| 2004/0079670 | A1 * | 4/2004 | Sendijarevic et al. | 206/523 |
| 2005/0279907 | A1 * | 12/2005 | Park | 248/460 |

* cited by examiner

*Primary Examiner*—J. Allen Shriver, II
*Assistant Examiner*—Bradley H Duckworth
(74) *Attorney, Agent, or Firm*—Mark Murphey Henry

(57) ABSTRACT

A field easel with an integrated sketch box is provided. The sketch box comprises cavities for art supplies, allowing art supplies to be stored inside the cavity and secured with plates covered in memory foam. An easel is hinged to the rear wall of the box such that the easel can display painting support in a multitude of angles, and the easel provides adjustable support clamps that accept different sizes of painting support and can raise and lower the height of the painting support with respect to the box. Optionally, the field easel can be secured to a standardized tripod.

3 Claims, 3 Drawing Sheets

FIELD EASEL WITH INTEGRATED PAINT/SKETCH BOX

CROSS REFERENCES

This application is a Continuation of U.S. application Ser. No. 11/704,395, filed Feb. 9, 2007 now abandoned, which has been previously assigned to Art Unit 3632.

GOVERNMENTAL RIGHTS

None.

BACKGROUND OF THE INVENTION

The invention relates to the field of art easels, and specifically to field easels having integrated storage capacity.

Easels have been used by artists for thousands of years to hold a canvas or other painting support while the artist worked. Traditionally, easels were constructed of wood using a tripod or H-frame configuration. The basic components of an easel include a base and horizontal members attached to the base for securing a painting support. Easels come in various sizes, ranging from fixed studio easels to tabletop easels to small field easels. Studio easels typically use a large, floor-standing base, while field easels often use integrated collapsible tripods.

A paint or sketch box usually refers to a covered storage box used to separate and store art supplies, and many sketch boxes can be used while an artist is painting to provide access to art supplies. While the sketch box can be a separate unit, some field easels utilize integrated sketch boxes. These types of integrated field easels are often unwieldy, requiring large amounts of setup time. It is thus an object of the present invention to provide an integrated field easel that minimizes the amount of setup time required.

Of those integrated field easels in the prior art, none attempted to organize and secure art supplies during travel. Because art supplies can shift during travel, the integrated field easels of the prior art required the artist to reorganize art supplies upon arriving at the desired location. Thus, it is also an object of the present invention to provide a sketch box capable of securing painting supplies during travel in an organized manner.

Another deficiency of integrated field easels of the prior art is that such easels often have tripods that are incapable of other uses. Today, tripods are used for a variety of purposes, including photography, and most modern tripods use standardized mounts such that many different types of equipment may be mounted on the universal mount tripod. Artists often photograph the subject matter of a work of art as well as painting in plain air in order to touch up the painting in a studio or to create similarly themed works of art using different painting supports. Easels of the prior art made this process difficult, as an artist wishing to both photograph and paint on a field easel was required to carry a separate tripod for an easel and a camera.

U.S. Pat. No. 4,093,326 (the "'326 patent"), utilizes a standardized tripod mount; however, the '326 patent's implementation of such standardized tripod mount defeats several purposes of a sketch box because the tripod is mounted by drilling a hole in the bottom of the sketch box and mounting the sketch box to the tripod using a wing nut. This method of mounting a sketch box to a tripod defeats many benefits of the sketch box because paint and other items can fall through or leak out the mounting hole during travel. Also, the single mount utilized by the '326 patent relies upon the sketch box structural material for strength rather than spreading the force exerted by the mount over a significant area, such as utilizing a metal base plate. Therefore, it is a further object of the present invention to provide a field easel that can utilize a standardized tripod as the base of the easel without compromising the structural integrity or the utility of the integrated sketch box.

Most integrated field easels of the prior art also lack a means to adjust the easel so that the painting support is at a comfortable painting height. That is, easels of the prior art allow adjustment of the tripod or other base to adjust the height of the painting support to a level comfortable for the artist, only. While two easels in public use do provide for vertical adjustment of a painting support with respect to the sketch box, the designs of U.S. Pat. No. 2,751,271 (the "'271 patent") and 6,308,925 (the "'925 patent") lack the requisite structural strength needed to prevent extraneous movement of the painting support while the artist works. In the '271 and '925 patents, the structure for the painting support holders is one-dimensional; that is, both painting support holders are attached to the same linear structural member. It is thus an object of the present invention to allow a user to adjust the height of a painting support without adjusting the tripod or other base, while at the same time providing greater than one-dimensional structural strength to the painting support holder.

A further deficiency of integrated field easels of the prior art is that such easels sacrifice usability and workspace for portability. It is thus another object of the present invention to provide an easel that is capable of being collapsed into a small size suitable for travel, including traveling with a wet or partially complete painting, while at the same time providing a sketch box having ample storage capacity for painting supplies and having ample workspace for painting.

Depending on the painting conditions, an artist may also need secure a painting support in either a vertical or a horizontal position. Thus, it is a further object of the present invention to provide an integrated field easel which is capable of being adjusted between a vertical and horizontal plane and to allow the user to incrementally set the angle at which the painting support is positioned.

It is a further object of the present invention to provide an easel with integrated sketch box that is capable of securing art supplies in a usable, visible position when the easel is in use.

BRIEF SUMMARY OF THE INVENTION

The apparatus in accordance with the present invention provides an adjustable, collapsible, compact integrated field easel with ample storage capacity for organizing art supplies and ample workspace for painting.

The present invention comprises two main components. The first component is a sketch box comprising a base with two side walls, a front wall, and a back wall and lids. A lid is hingeably attached to each side of the base. In a closed position, both lids form a top for the sketch box while the base forms the bottom. The lids are optionally secured in this closed position using a hasp or other securing means. In an open position, the lids allow access to the interior of the base, and when the lids are fully opened along the hinge axis, the base and lids form a working surface. The interior cavity of the base and the lids permit storage of art supplies, and in the preferred embodiment, these cavities are further equipped with moldable memory foam to secure art supplies.

The second component of the present invention is the easel, which is hingeably attached to the rear wall of the base. The easel portion of the invention comprises an easel tray, adjustable support clamps, a lattice for securing the adjustable support clamps in the desired configuration using up to two dimensions of structural support, and means for securing the easel at a desired angle with respect to the base. In the closed and collapsed position, the easel folds to cover the top. The easel may be secured in the closed position using buckle fasteners or other securing means on the front. In an open and expanded configuration, the easel can be secured in a full 180° field of movement along the hinge axis. The adjustable support clamps can be raised and lowered.

The base may have a standardized tripod adapter.

These and other advantages will become apparent from the following detailed description which, when viewed in light of the accompanying drawings, disclose the embodiments of the present invention.

DETAILED DESCRIPTION OF THE INVENTION

Figure 1:
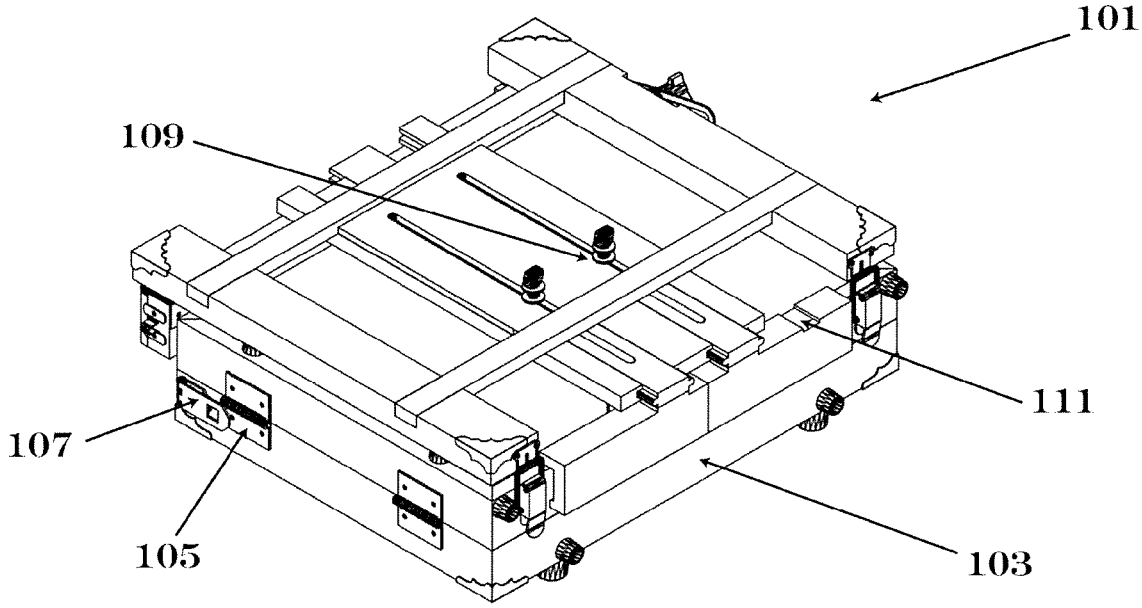
FIG. 1 is a perspective view of the preferred embodiment of the present invention in a closed configuration.

Turning now to FIGS. 1 through 5, field easel 101 comprises box 103 and easel 201. Box 103 has a front wall 203, a back wall 205, two side walls 207, and a bottom 501. The walls and bottom 501 of box 103 create box cavity 209 designed for storing art supplies, and optional dividers 211 serve to separate art supplies inside box cavity 209. In the preferred embodiment, brush cavity 213 is formed from dividers 211 to separate paintbrushes from remaining art supplies, which keeps paintbrushes from inadvertently coming into contact with other art supplies inside box cavity 209 during travel.

One or more lids 215 comprise the top of box 103; in the preferred embodiment, there are two lids 215. Lids 215 are connected to the side walls 207 of box 103 via lid hinges 105. Lid hinges 105 have a range of motion such that lids 215 can rest on top of box 103, or lids 215 can be opened to rest substantially flush to side walls 207 of box 103.

Lids 215 have lid cavities 217 for additional storage of art supplies. Optionally, lid cavities 217 may also have dividers 211. Plates 219 are made of a rigid material and are covered in memory foam and have slightly smaller dimensions than lid cavities 217. Art supplies are placed into lid cavities 217, and plates 219 are pressed into lid cavities 217 to cover the art supplies. Catch cutouts 221 are either cut into the memory foam or fashioned by the artist by compressing the memory foam, and catches 223 rotate into catch cutouts 221. Catches 223 can only rotate into or out of catch cutouts 221 when the artist applies pressure to plates 219 in the direction of lids 215. When plates 219 are secured by catches 223, the memory foam on plates 219 prevents art supplies in lid cavities 217 from moving during travel. When lids 215 are closed, memory foam on plates 219 opposite the side of lid cavities 217 prevents art supplies in box cavity 209 from moving during travel.

Easel 201 comprises an easel tray 401 and a lattice 225. Easel tray 401 is mounted to back wall 205 of box 103 using one or more easel tray hinges 503. Easel tray 401 has a range of motion of substantially 90°, as demonstrated by FIGS. 3 and 4. The purpose of easel tray 401 is to allow lattice 225 to fold over and cover the top of box 103 when field easel 101 is in a collapsed position. When the artist is using field easel 101, easel tray 401 is secured to box 103 using optional clasp 107 for additional stability.

Lattice 225 is attached to easel tray 401 using one or more lattice hinges 227. Lattice hinges 227 allow lattice 225 to be configured anywhere within a substantially 90° range of motion with respect to easel tray 401. When the artist places lattice 225 at the desired angle with respect to easel tray 401 and box 103, securing means 229 may be engaged so that lattice 225 is secured in the desired configuration. In the preferred embodiment, securing means 229 consists of a metal friction lid support engaged with a knob-handled screw.

The main purpose of lattice 225 is to secure painting support for painting, and adjustable support clamps 231 serve this purpose. Two grooved tracks 233 are mounted on lattice 225. Adjustable support clamps 231 are mounted on tongued rails 235, and tongued rails 235 slide along grooved tracks 233. The position of the adjustable support clamps 231 can be easily configured to a position dictated by the size of the painting support and preferred by the artist by sliding tongued rails 235 along grooved tracks 233. When the artist has the adjustable support clamps 231 holding the painting support in the desired position, the artist can secure adjustable support clamps 231 by tightening retention bolts 109. In the preferred embodiment, retention bolts 109 comprise a spring-loaded quick connect or bolts secured by wing nuts. Tongued rails 235 can be inserted into grooved tracks 233 with adjustable support clamps 231 pointing either towards or away from box 103. When tongued rails 235 are inserted into grooved tracks 233 such that adjustable support clamps 231 point towards box 103, notches 111 prevent adjustable support clamps 231 from snagging on retention bolts 109. Optionally, lattice 225 may accept a clamp for a mahl stick for detail work or for an umbrella for painting in inclement weather.

Lattice 225 has buckle fastener clips 237 which may be secured to buckle fasteners 239 mounted on lids 215 for the purpose of securing easel 201 to box 103 during travel.

In a closed configuration, shown generally by FIG. 1, easel tray 401 folds up into travel configuration 301 and lattice 225 folds over the top of box 103 and closed lids 215. In the preferred embodiment, safety hasp 505 secures the lids to each other to prevent inadvertent opening of lids 215. Buckle fastener clips 237 on lattice 225 and buckle fasteners 239 on lids 215 secures easel 201 to a lids 215. For carry without a painting, tongued rails 235 are inserted into grooved tracks 233 such that adjustable support clamps 231 face front wall 203 of box 103. In this closed configuration, offset clips 303 are used to limit the travel of easel 201 towards box 103, which creates a storage space 305 between easel 201 and box 103 for unused painting supports, for completed pastel, watercolor, or acrylic paintings, or for painting palettes. In the preferred embodiment, storage space 305 is large enough to hold a 9"×12" painting palette.

Figure 2:
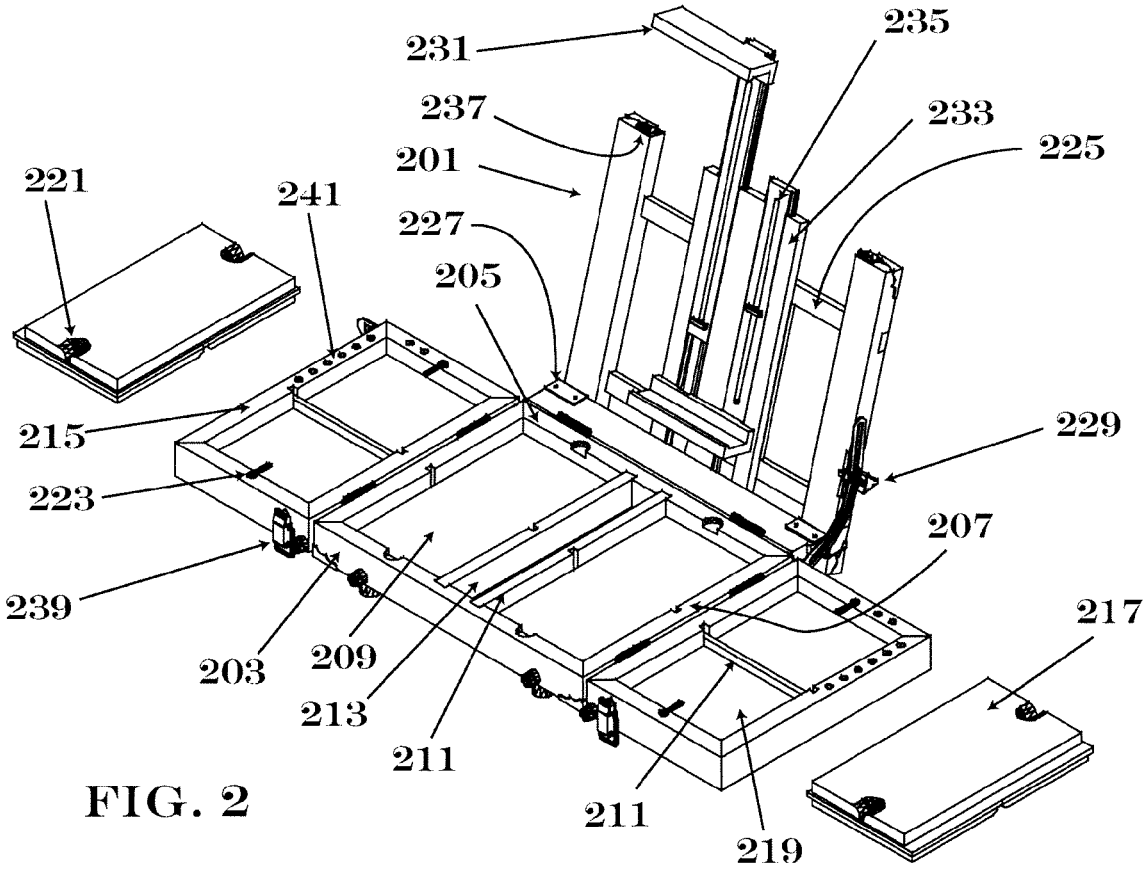
FIG. 2 is a perspective view of the preferred embodiment of the present invention in an open configuration.
Figure 3:
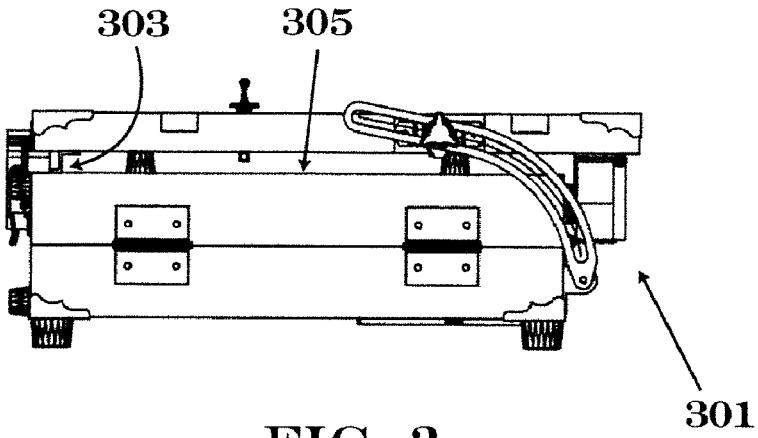
FIG. 3 is a side view of the preferred embodiment of the present invention in a closed configuration.
Figure 4:
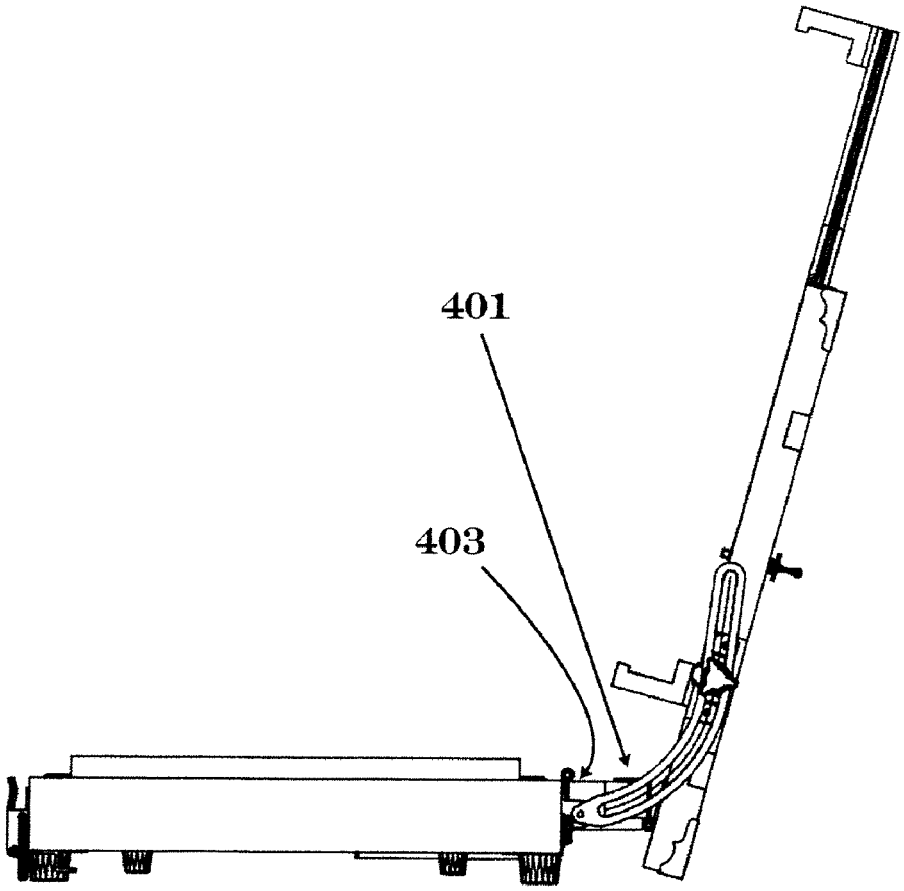
FIG. 4 is a side view of the preferred embodiment of the present invention in an open configuration.

To set up the invention for painting, the artist begins by releasing buckle fasteners 239. Easel 201 folds away from box 103 until easel tray 401 is substantially flush with the top of back wall 205 of box 103, and clasp 107 secures easel tray 401 and box 103 in substantially flush configuration 403. Lattice 225 is placed at the proper angle by the artist, and securing means 229 operates to secure lattice 225 in an open configuration such that the angle between lattice 225 and box 103 remains constant. A general drawing of field easel 101 in an open configuration is shown in FIG. 2.

Once easel 201 is opened and secured, lids 215 are folded to side walls 207 of box 103 to create a workspace and to expose art supplies in box cavity 209. The artist presses down on plates 219, rotates catches 223 out of catch cutouts 221, and lifts plates 219 away from lid cavities 217, which exposes art supplies in lid cavities 217. The artist removes paintbrushes from brush cavity 213 and places the paintbrushes into brush holders 241.

To mount the painting support on easel 201, the artist has three options. The first option is to remove adjustable support clamps 231 and to rest the bottom of the painting support on easel tray 401. The second option is to rest the bottom of the painting support on easel tray 401 and to secure the top of the painting support using adjustable support clamps 231. The third option is to secure the bottom of the painting support using one of adjustable support clamps 231 and to secure the top of the painting support using another of adjustable support clamps 231. Once the painting support is in place, the artist may begin painting.

After the artist finishes an oil painting, the paintbrushes are returned to brush cavity 213 and other art supplies are returned to box cavity 209 and lid cavities 217. Plates 219 are pressed into lid cavities 217, and catches 223 are rotated into catch cutouts 221. Lids 215 are folded onto the top of box 103. Securing means 229 is loosened, lattice 225 is oriented vertically, and securing means 229 are retightened. Tongued rails 235 are inserted into grooved tracks 233 such that adjustable support clamps 231 face away from box 103 with one adjustable support clamp 231 facing up and another adjustable support clamp 231 facing down. The painting is mounted onto adjustable support clamps 231, and retention bolts 109 are tightened. Clasp 107 is released, securing means 229 is loosened, easel 201 is folded over the top of box 103, and buckle fasteners 239 are engaged to buckle fastener clips 237. This process secures field easel 101 for travel, with the painting secured to and facing away from field easel 101.

When the artist finishes a pastel, watercolor, or acrylic painting, the paintbrushes are returned to brush cavity 213 and other art supplies are returned to box cavity 209 and lid cavities 217. Plates 219 are pressed into lid cavities 217, and catches 223 are rotated into catch cutouts 221. Lids 215 are folded onto the top of box 103. The painting support is placed on top of lids 215 inside storage space 305. Clasp 107 is released, securing means 229 is loosened, easel 201 is folded over the top of box 103, and buckle fasteners 239 are engaged to buckle fastener clips 237. Tongued rails 235 are inserted into grooved tracks 233 such that adjustable support clamps 231 face toward the front of box 103, and tongued rails 235 are slid into grooved tracks 233 until the adjustable support clamps 231 are flush with lids 215. This process secures field easel 101 for travel, with the completed painting secured between easel 201 and lids 215 in storage space 305.

Figure 5:
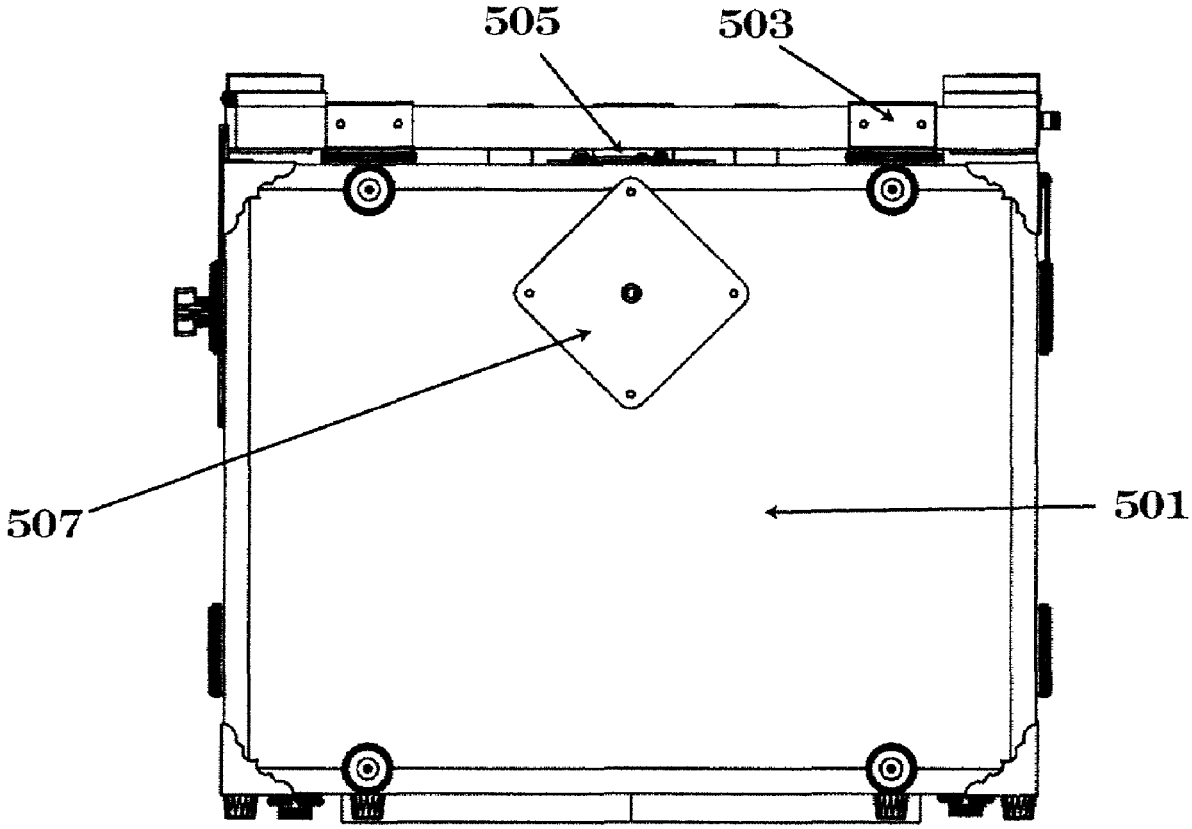
FIG. 5 is a bottom view of the preferred embodiment of the present invention in a closed configuration.

Turning now to FIG. 5, box 103 has an optional female tripod adapter 507 on bottom 501 for securing field easel 101 to a standardized tripod. The tripod adapter 507 gives the artist the option of using a standardized tripod as the base of field easel 101, or using another object such as a table, rock, or the ground.

In accordance with the present invention, a field easel provides improved portability while providing ample storage capacity for art materials. However, it should be clear that the present invention is not to be construed as limited to the forms shown, which are to be considered illustrative rather than restrictive.

We claim:

1. A field easel, comprising:

a sketch box base having a box base front wall, box base back wall, box base side walls, a box base bottom, and a box base bottom cavity created thereby, collectively defining an outside dimension of the sketch box base;

at least one base rigid divider insert positioned within the sketch box base wherein a first end of the divider insert is positioned substantially perpendicular to the sketch box base front wall and the sketch box base back wall, and wherein the divider insert is also substantially consistent in height as the sketch box base side walls, thereby dividing the sketch box base bottom cavity to create a first base bottom cavity storage chamber and a second base bottom cavity storage chamber;

at least two top lids foldably secured by lid hinges to each of the side walls of the sketch box such that the top lids, together, can be foldably moved from a closed position in which the two top lids substantially cover the outside dimension of the sketch box base bottom thereby covering the cavity of the sketch box to an open position wherein the two top lids are located immediately adjacent to each of the side walls of the sketch box along a hinge line, wherein the two top lids have a lid front wall, lid back wall, lid side walls, a lid bottom, and a lid bottom cavity created thereby;

at least one top lid divider insert positioned within each of the two top lids, wherein a first end of the divider insert is positioned substantially parallel to the top lid front wall and the top lid back wall, and wherein the divider insert is also substantially consistent in height as the top lid side walls, thereby dividing the sketch box top lids to create at least four top lid cavities;

at least one compressible plate having a rigid or semi-rigid substrate covered in memory foam that are sized to substantially occupy the volume of the first base bottom cavity storage chamber and the corresponding volume of the two top lid cavities; wherein the compressible plate further comprises catch cutouts which are capable of securing the compressible plates within either the first base bottom cavity storage chamber or the corresponding two top lid cavities and securing art supplies therein or thereunder;

a vertically adjustable easel lattice having at least two horizontally oriented cross member supports connecting two end easel support members; said cross member supports adding rigidity to the two end easel support members; wherein the vertically adjustable easel lattice is hingeably attached to the box base back wall with one or more easel tray hinges and wherein the vertically adjustable easel lattice is sized to substantially compare with the outside dimension of the sketch box base, wherein the vertically adjustable easel lattice may be rotated from a closed position covering the top lids to a substantially upright position along the one or more hinges likewise attached to the box base back wall; wherein the vertically adjustable easel lattice is further comprised of a top support clamp and a bottom support clamp that are connected with at least two tongued rails, said tongued rails being securable into a first and a second position, said tongued rails also being connected to at least one horizontally oriented cross member support;

a friction lid support that is connected to the vertically adjustable easel lattice and the outside surface of the box base side wall, wherein the friction lid support is releasably secured to permit the user opportunity to preferentially position the vertically adjustable easel lattice along the length of the friction lid support;

a first securing means to connect the two top lids to the sketch box base;

a second securing means to connect the vertically adjustable easel lattice to the sketch box base.

2. The field easel of claim 1, wherein the sketch box base incorporates a universal tripod adapter mount.

3. The field easel of claim 1, wherein the outside dimension of the sketch box base and vertically adjustable easel lattice, in a closed position, are substantially sized to adaptably secure a 9"×12" painting palette between the vertically adjustable easel lattice and the two top lids in their closed position.

* * * * *